US011452347B1

(12) United States Patent
Johnson

(10) Patent No.: US 11,452,347 B1
(45) **Date of Patent: *Sep. 27, 2022**

(54) PERSONAL FOGGING UMBRELLA

(71) Applicant: Coolbrella, Inc., Scottsdale, AZ (US)

(72) Inventor: Plas Johnson, Scottsdale, AZ (US)

(73) Assignee: Coolbrella, Inc., Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/600,110

(22) Filed: Oct. 11, 2019

Related U.S. Application Data

(63) Continuation of application No. 16/125,097, filed on Sep. 7, 2018, now Pat. No. 10,448,714.

(51) Int. Cl.

| | |
|---|---|
| ***A45B 9/02*** | (2006.01) |
| ***A45B 3/00*** | (2006.01) |
| ***A45B 23/00*** | (2006.01) |
| *A45B 9/00* | (2006.01) |

(52) U.S. Cl.
CPC ..... *A45B 3/00* (2013.01); *A45B 9/02* (2013.01); *A45B 23/00* (2013.01); *A45B 2009/005* (2013.01); *A45B 2200/1045* (2013.01)

(58) Field of Classification Search
CPC ..... A45B 2200/1045; A45B 9/02
See application file for complete search history.

(56) References Cited

U.S. PATENT DOCUMENTS

| | | | | |
|---|---|---|---|---|
| 5,979,793 | A * | 11/1999 | Louis | A45B 3/00 135/16 |
| 6,682,000 | B1 * | 1/2004 | Apple | A45B 3/00 239/289 |
| 6,886,759 | B1 * | 5/2005 | Okronick | A45B 3/00 239/16 |
| 7,104,270 | B2 * | 9/2006 | Dong | A45B 3/00 135/16 |
| 7,412,984 | B1 * | 8/2008 | Spencer | A45B 3/00 135/16 |
| 7,497,225 | B1 * | 3/2009 | Klein, Jr | A45B 3/00 135/118 |
| 7,513,126 | B2 * | 4/2009 | Boland | F24F 5/0035 62/310 |
| 9,072,349 | B1 * | 7/2015 | Thompson | A45B 25/00 |
| 9,750,318 | B2 * | 9/2017 | Rao | A45B 23/00 |
| 10,051,931 | B2 * | 8/2018 | Zadie | F24S 25/10 |
| 10,238,191 | B2 * | 3/2019 | Shurie | A45B 25/00 |

(Continued)

*Primary Examiner* — Noah Chandler Hawk
(74) *Attorney, Agent, or Firm* — Booth Udall Fuller, PLC

(57) ABSTRACT

A personal fogging umbrella having a handle, a head, and a pressurizer is disclosed. The handle includes a hollow cavity that is watertight. The head is coupled to the top end of the handle and comprises a plurality of two-stage fogging nozzles feed pressurized air and water from the hollow cavity of the handle through conduits. The head is pivotally coupled to a plurality of ribs connected to a flexible canopy. The pressurizer is releasably coupled to the bottom end of the handle and has a one-way valve connected to a pump to pressurize the air inside the hollow cavity. The handle has a shoulder rest, the handle extending upward from the shoulder rest toward the top end and extending outward to curve downward toward the bottom end. The handle above the shoulder rest is substantially linear, and the handle below the shoulder rest is at least partially curved.

20 Claims, 6 Drawing Sheets

(56) References Cited

U.S. PATENT DOCUMENTS

| | | | | |
|---|---|---|---|---|
| 2005/0161066 | A1* | 7/2005 | Ma | A45B 23/00 135/16 |
| 2005/0172987 | A1* | 8/2005 | Byrnes | A45B 3/00 135/33.5 |
| 2008/0048051 | A1* | 2/2008 | Chang | A45B 11/04 239/289 |
| 2008/0179426 | A1* | 7/2008 | Johnson | A45B 3/00 239/289 |
| 2012/0103376 | A1* | 5/2012 | Becher | A45B 3/00 135/16 |
| 2013/0213446 | A1* | 8/2013 | Rao | A45B 23/00 135/16 |
| 2015/0144165 | A1* | 5/2015 | Rao | A45C 13/40 135/16 |
| 2015/0366305 | A1* | 12/2015 | Edwards | A45B 25/00 135/16 |
| 2019/0053588 | A1* | 2/2019 | Price | A45B 19/04 |

* cited by examiner

PERSONAL FOGGING UMBRELLA

RELATED APPLICATIONS

This application is a continuation application of the U.S. Nonprovisional application Ser. No. 16/125,097, filed on Sep. 7, 2018, titled "Personal Fogging Umbrella,", the entire contents of which are hereby incorporated by reference herein.

TECHNICAL FIELD

Aspects of this document relate generally to fogging umbrellas.

BACKGROUND

The evaporation of water has long been used to manipulate air temperature to make an otherwise hot environment more comfortable. Evaporative cooling becomes more difficult to harness practically in a personal context, particularly in scenarios where an individual needs to be mobile and not overly encumbered, such as construction and other strenuous activities.

Conventional personal cooling systems have relied on misters to reduce air temperature. However, misters can go through water quickly. To operate for a sufficient amount of time, a user would have to carry a large water supply and/or large batteries. This weight would have to be either carried by hand, which quickly becomes tiresome, or strapped on the users body, slowing the process of starting and stopping use.

Due to the proximity of blood vessels to the skin, a person's face and neck are excellent targets for cooling. Reducing the temperature of a persons face and neck creates a better cooling sensation than a similar reduction to other body parts. Despite this, many conventional cooling systems have placed water emitters around a perimeter of an umbrella or shade, which tends to be far away from a users face and neck.

SUMMARY

According to one aspect, a personal fogging umbrella includes a handle having a top end, a bottom end, and a hollow cavity that is watertight and spans from the top end to the bottom end. The personal fogging umbrella also includes a head coupled to the top end of the handle. The head includes a plurality of spreader arms, a control valve, and at least three two-stage fogging nozzles, each nozzle in fluid communication with an upper end of the hollow cavity proximate the top end via an air conduit and with a lower end of the hollow cavity proximate the bottom end via a water conduit. The plurality of spreader arms are pivotally coupled to the head. The personal fogging umbrella further includes a collar slidably coupled to the handle, a plurality of ribs, each rib pivotally coupled to the collar and a different one of the plurality of spreader arms, a flexible canopy coupled to the plurality of ribs, and a pressurizer releasably coupled to the bottom end of the handle. The pressurizer includes a one-way valve in fluid communication with the control valve of the head through the hollow cavity. The one-way valve is oriented to allow fluid introduction and prevent fluid withdrawal from the hollow cavity. The handle further includes a shoulder rest between the top end and the bottom end, the handle extending upward from the shoulder rest toward the top end and extending outward to curve downward toward the bottom end. Finally, the handle above the shoulder rest is substantially linear, and the handle below the shoulder rest is at least partially curved.

Particular embodiments may comprise one or more of the following features. The pressurizer may be a hand-powered pressurizer, and may include a hand-operated pump coupled to the one-way valve and having a piston that may be substantially parallel to the handle proximate the bottom end. The pressurizer may be an electric-powered pressurizer and may include an electromechanical pump coupled to the one-way valve and communicatively coupled to at least one battery. The at least one battery may be rechargeable and may be communicatively coupled to a charging port on the pressurizer. The personal fogging umbrella may further include a pressure sensor communicatively coupled to a processor, the processor may also be communicatively coupled to the electromechanical pump and may be programmatically configured to operate the electromechanical pump to maintain an air pressure between 60 and 80 psi within the hollow cavity. The personal fogging umbrella may further include a check valve between the hollow cavity and the at least three air conduits. The check valve may be oriented such that it is closed when the umbrella is inverted.

According to another aspect, a personal fogging umbrella includes a handle having a top end, a bottom end, and a hollow cavity that is watertight and spans from the top end to the bottom end. The personal fogging umbrella also includes a head coupled to the top end of the handle, the head including a plurality of spreader arms, a control valve, and a plurality of two-stage fogging nozzles. Each nozzle is in fluid communication with an upper end of the hollow cavity proximate the top end via an air conduit and with a lower end of the hollow cavity proximate the bottom end via a water conduit. The plurality of spreader arms are pivotally coupled to the head. The personal fogging umbrella further includes a collar slidably coupled to the handle, a plurality of ribs, each rib pivotally coupled to the collar and a different one of the plurality of spreader arms, a flexible canopy coupled to the plurality of ribs, and a pressurizer releasably coupled to the bottom end of the handle. The pressurizer includes a one-way valve in fluid communication with the control valve of the head through the hollow cavity. The one-way valve is oriented to allow fluid introduction and prevent fluid withdrawal from the hollow cavity. Finally, the handle further includes a shoulder rest between the top end and the bottom end, the handle extending upward from the shoulder rest toward the top end and extending outward to curve downward toward the bottom end.

Particular embodiments may comprise one or more of the following features. The handle above the shoulder rest may be substantially linear, and/or the handle below the shoulder rest may be at least partially curved. The personal fogging umbrella may further include a check valve between the hollow cavity and the at least one air conduits, and the check valve may be oriented such that it is closed when the umbrella is inverted. Lastly, the hollow cavity may be sized to hold approximately 32 oz. of water when ¾ full.

According to yet another aspect a personal fogging umbrella includes a handle having a top end, a bottom end, and a hollow cavity that is watertight and spans from the top end to the bottom end. The personal fogging umbrella further includes a head coupled to the top end of the handle and comprising a plurality of spreader arms, a control valve, and a plurality of two-stage fogging nozzles. Each nozzle is in fluid communication with an upper end of the hollow cavity proximate the top end via an air conduit and with a lower end of the hollow cavity proximate the bottom end via a water conduit. The plurality of spreader arms are pivotally coupled to the head. The personal fogging umbrella also includes a collar slidably coupled to the handle, a plurality of ribs, each rib pivotally coupled to the collar and a different one of the plurality of spreader arms, a flexible canopy coupled to the plurality of ribs, and a pressurizer releasably coupled to the bottom end of the handle and in fluid communication with the control valve of the head through the hollow cavity.

Particular embodiments may comprise one or more of the following features. The handle may further include a shoulder rest between the top end and the bottom end. The handle may extend upward from the shoulder rest toward the top end and/or extend outward to curve downward toward the bottom end. The handle above the shoulder rest may be substantially linear, and/or the handle below the shoulder rest may be at least partially curved.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1:
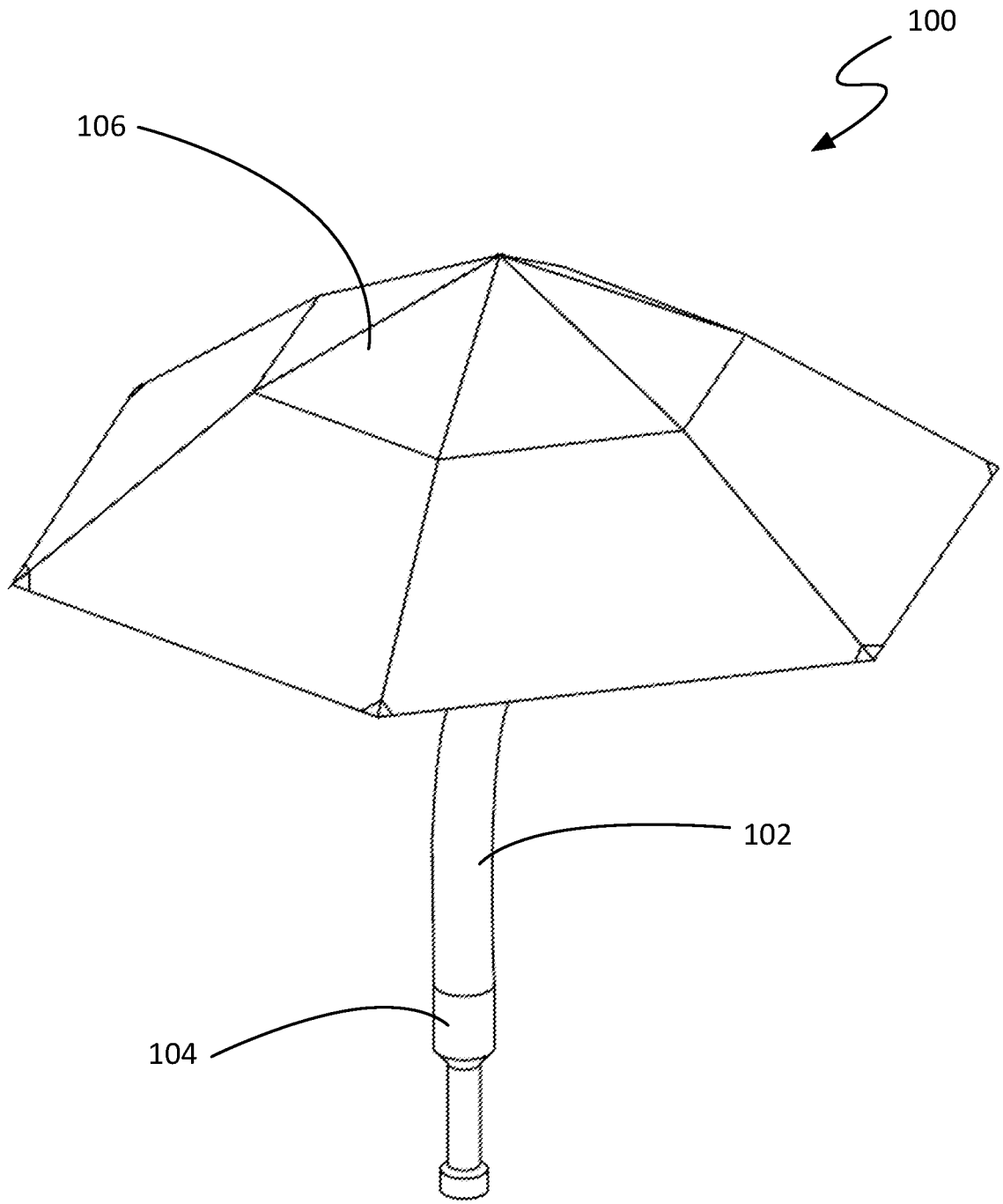
FIG. 1 is a perspective view of a personal fogging umbrella.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Conventional personal cooling systems have relied on misters to reduce air temperature. However, misters can go through water quickly. To operate for a sufficient amount of time, a user would have to carry a large water supply and/or large batteries. This weight would have to be either carried by hand, which quickly becomes tiresome, or strapped on the users body, slowing the process of starting and stopping use. This can be problematic, as often the reason the user has left the comfort of an air conditioned interior is to perform some sort of task.

Due to the proximity of blood vessels to the skin, a person's face and neck are excellent targets for cooling. Reducing the temperature of a persons face and neck creates a better cooling sensation than a similar reduction to other body parts. Despite this, many conventional cooling systems have placed water emitters around a perimeter of an umbrella or shade, which tends to be far away from a users face and neck.

Contemplated herein is a personal fogging umbrella 100 comprising a plurality of two-stage fogging nozzles that siphon water from a hollow cavity inside the umbrella handle using air that has been pressurized by a pressurizer attached to the bottom of the handle. The use of high pressure, two-stage (i.e. syphoning water with pressurized air) fogging nozzles is advantageous over conventional misting devices, as less water is used while providing better cooling through the flash evaporation of the smaller water droplets. The increased efficiency of the foggers means that less water needs to be carried, making the personal fogging umbrella 100 more convenient in scenarios where mobility is needed. Furthermore, as will be discussed below, the handle may be shaped such that some of the weight of the umbrella may be rested upon a users shoulder, further facilitating mobility, an area where conventional personal cooling systems has long struggled.

Figure 2:
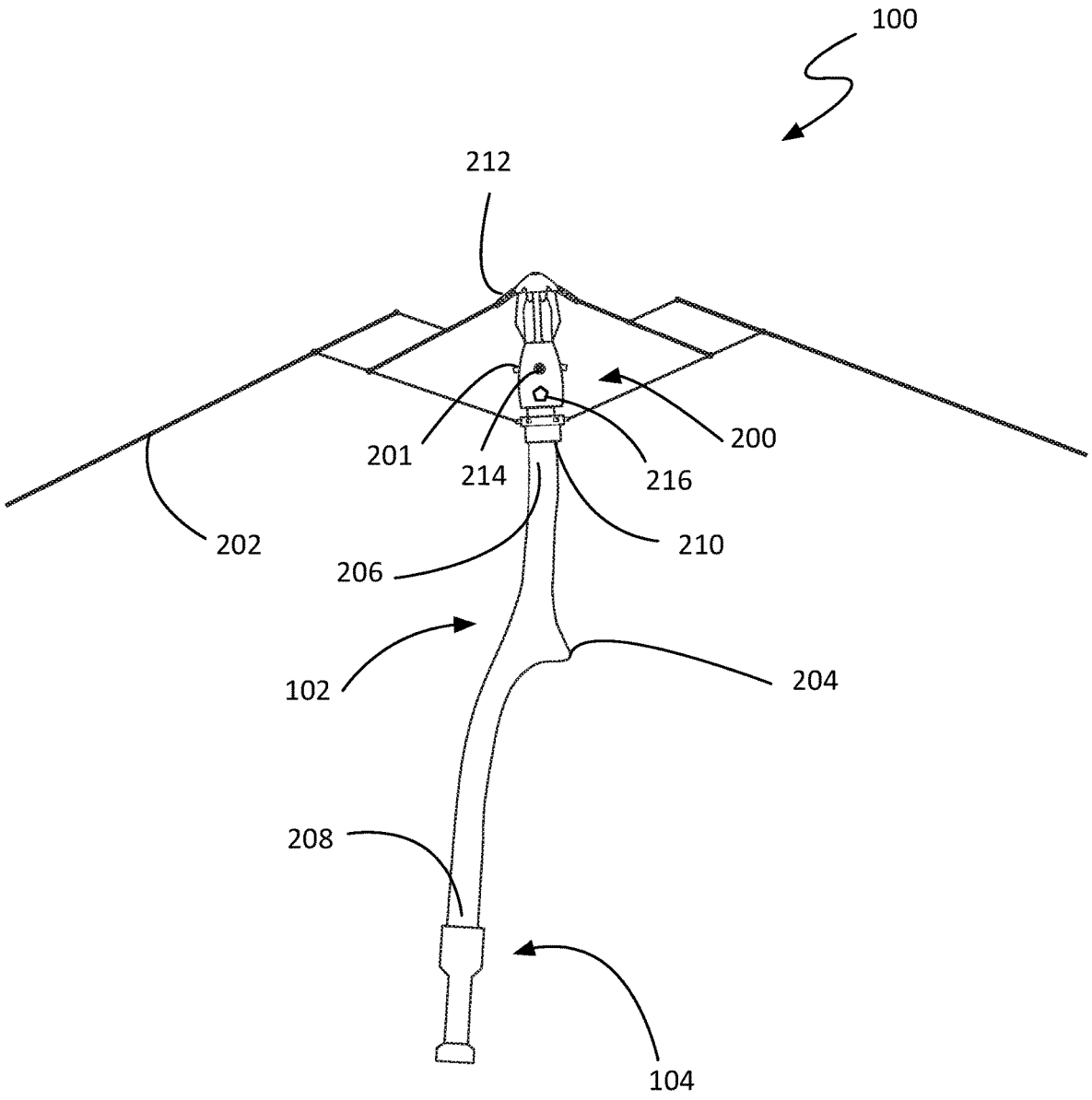
FIG. 2 is a side view of the personal fogging umbrella of FIG. 1.
Figure 3:
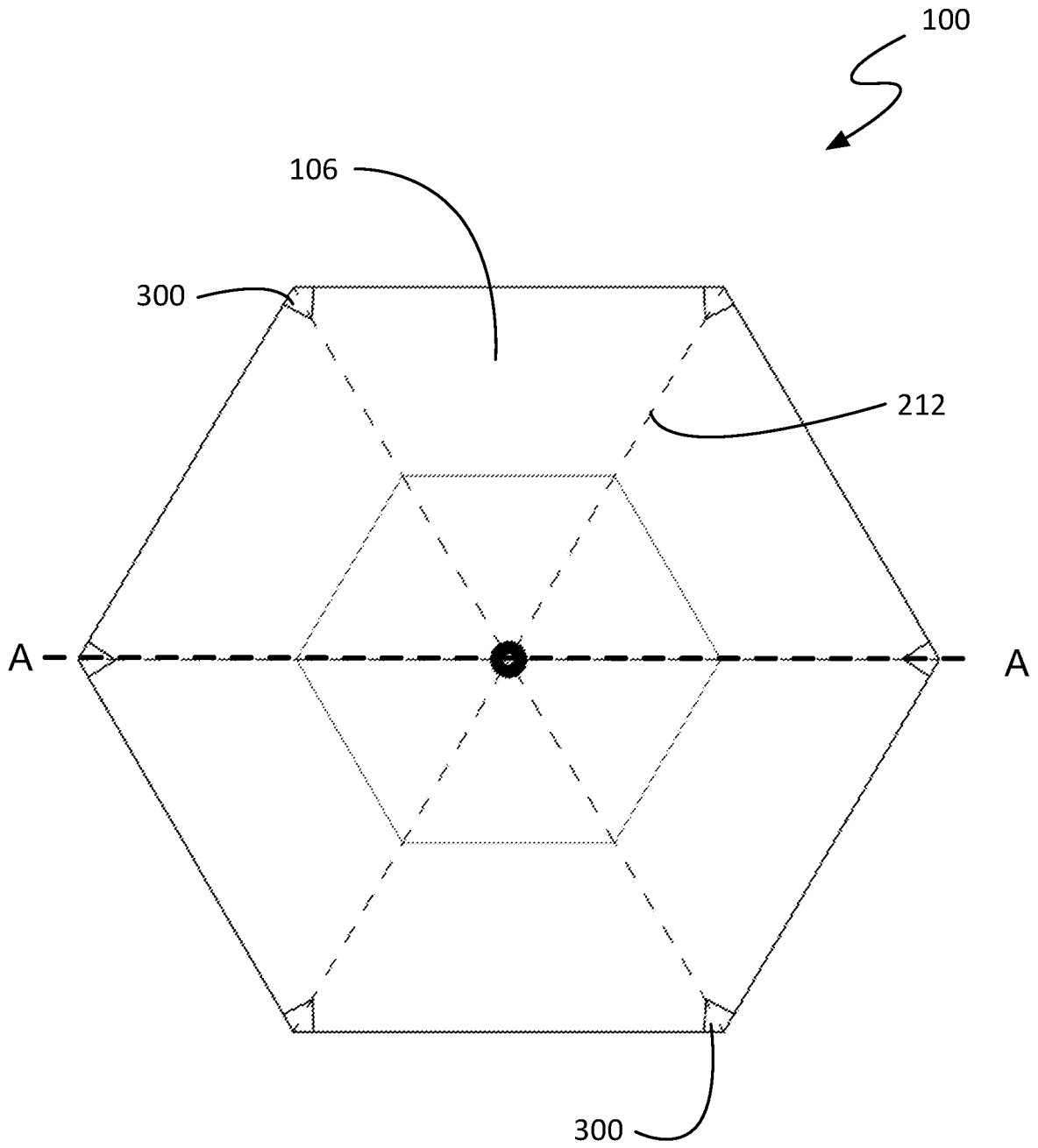
FIG. 3 is a top view of the personal fogging umbrella of FIG. 1.

FIGS. 1, 2, and 3 show a non-limiting example of a personal fogging umbrella 100, in an open position. Specifically, FIG. 1 is a perspective view, FIG. 2 is a side view, and FIG. 3 is a top view. It should be noted that FIG. 2 does not include the flexible canopy 106 or a number of ribs 202, for clarity.

As shown, the personal fogging umbrella 100 comprises a handle 102, with a pressurizer 104 on one end and a head 200 on the other. The head 200 is pivotally coupled to a plurality of ribs 202 that support a flexible canopy 106. The ribs 202 are also pivotally coupled to a collar 210 that slides up and down the handle 102.

In operation, water is held within the handle 102 along with air that is pressurized by the pressurizer 104 at the end of the handle 102. While holding the open umbrella 100, the user activates a valve that allows the pressurized air to siphon the water through a series of fogging nozzles, ejecting an atomized fog that evaporates almost instantly, reducing the temperature of the air and cooling the user. Various components and aspects of the operation will be discussed in much greater detail below.

As shown, the handle 102 has a top end 206 and a bottom end 208. As will be discussed in greater detail with respect to the sectional view of FIG. 4, the handle 102 also comprises a hollow cavity 400 that is watertight. The handle 102 (or more specifically, the hollow cavity 400) is used to store a supply of water.

A common problem in conventional personal cooling systems is their weight. To operate for a sufficient amount of time, a user would have to carry a large water supply and/or large batteries. This weight would have to be either carried by hand, which quickly becomes tiresome, or strapped on the users body, slowing the process of starting and stopping use. This can be problematic, as often the reason the user is not in the comfort of an air conditioned interior is because they must perform some sort of task out in the heat. Having to carry a heavy device, or not being able to get free from the weight of a device, can make these tasks difficult.

The handle 102 of the personal fogging umbrella 100 may be shaped to facilitate use, making it easy to bear the weight of the umbrella 100 while still being able to be quickly and easily set down or picked up. According to various embodiments, the handle 102 may have a shoulder rest 204 somewhere between the top end 206 and the bottom end 208. In the context of the present description and the claims that follow, a shoulder rest 204 is a feature or shape that is part of the handle 102 that allows the handle to rest upon a shoulder of the user, allowing the should to bear at least some of the weight of the umbrella 100. In some embodiments, the shoulder rest 204 is formed by the shape of the handle 102 itself, while in other embodiments, the shoulder rest 204 may be a structure that has been attached to the handle 102. In some embodiments, the shoulder rest 204 may contain a portion of the hollow cavity 400 of the handle 102, while in other embodiments the shoulder rest 204 may not.

In the non-limiting example shown in FIG. 2, the handle 102 comprises a shoulder rest 204, where the handle 102 bends. As shown, the handle 102 extends upward from the rest 204 and is substantially linear (i.e. linear to within 20°), while the handle 102 below the rest 204 is at least partially curved downward. The shape of the handle 102 and the rest 204 is such that a user, when holding the umbrella 100 such that the shoulder rest 204 is on one of their shoulders, only has to support part of the total weight with their hand, the remainder being supported by their shoulder while also placing the head 200 close to the user's head and neck, prime targets for cooling. The lower portion of the handle 102 curves outward, allowing the user to hold the umbrella 100 in their hand as the head 200 is in an effective position and the shoulder rest 204 is in place, without having to extend their arm much from their body.

In some embodiments, the position of the shoulder rest 204 on the handle 102 may be chosen such that when the umbrella 100 is in an open position and has been fully supplied with water and is at its heaviest, the mass is distributed with respect to the rest 204 such that it can be balanced on a users shoulder. As the water supply is used up, the balance may shift, but the overall weight is also dropping. In other embodiments, the rest 204 may be positioned such that a balance is achieved under different circumstances (e.g. balance after 20% of the water has been used, etc.) to provide a better user experience.

The shoulder rest 204 shown in FIG. 2 is formed by the shape of the handle 102. In other embodiments, the shoulder rest 204 may be something that is attached to the handle 102. For example, in one embodiment, the shoulder rest 204 may be a hook coupled to the handle 102 and sized to comfortably sit on a shoulder. In another embodiment, the shoulder rest 204 may be a smaller hook, or other structure, configured to couple with a loop, strap, or other object on or near the users shoulder. This may be advantageous in cases where the user is already wearing some sort of harness, either for safety or for utility.

As previously mentioned, the pressurizer 104 is used to pressurize the air that is used to siphon water through the fogging nozzles 201 in the head 200. As shown, it is releasably coupled to the bottom end 208 of the handle 102. In some embodiments, including the non-limiting example shown in FIG. 5, the pressurizer 104 may be hand powered. In other embodiments, including the non-limiting example shown in FIG. 6, the pressurizer 104 may be electric powered. In still other embodiments, the pressurizer 104 may simply be a regulated supply of pressurized gas, such as a refillable canister or an input configured to receive disposable gas cartridges, like CO2 cartridges. Such embodiments may be useful in environments where air compressors are readily available, such as some construction sites.

As shown in FIG. 2, some embodiments of the personal fogging umbrella 100 may also include a safety release pressure valve 216. The safety release pressure valve 216 is in fluid communication with the upper end 402 of the hollow cavity 400, and is configured to safely release pressure from the hollow cavity 400 before reaching a point of rupture. In some embodiments, the safety release pressure valve 216 may be located on the handle 102, while in others it may be located on the head 200.

As will be discussed in greater detail with respect to FIGS. 5 and 6, the pressurizer 104 may comprise a one-way valve that is exposed to the hollow cavity 400 of the handle 102 and oriented so the water inside the cavity cannot enter the pressurizer 104, but the pressurizer is able to introduce air into the cavity.

The head 200 of the personal fogging umbrella 100 is coupled to the top end 206 of the handle 102, and is also pivotally coupled to a plurality of ribs 202, according to various embodiments. As shown in FIG. 2, the head 200 comprises a plurality of spreader arms 212, each of which is coupled to a rib 202 that supports the flexible canopy 106 shown in FIGS. 1 and 3. The head 200 further comprises a control valve 214, and a plurality of two-stage fogging nozzles 201. The two-stage fogging nozzles 201 will be discussed in further detail with respect to FIG. 4.

According to various embodiments, the control valve 214 is used to activate the two-stage fogging nozzles 201, in an on/off fashion. In some embodiments, the control valve 214 may also alter the intensity of the fogging, or the flow of pressurized air through the head 200. Exemplary control valves 214 include, but are not limited to, push rods, rotating valves, ball valves, and the like. Some control valves 214 that are configured to modify the flow rate may have discrete levels, such as "low" and "high", while other control valves 214 may provide a continuous range of flow rates.

As shown, the plurality of ribs 202 may be coupled to the spreader arms 212 of the head 200. They are also pivotally coupled to a collar 210 that is configured to slide up and down the handle 102, as is known in the art of umbrellas. In the non-limiting example shown in FIGS. 1-3, the personal fogging umbrella 100 comprises six ribs 202. Other embodiments may make use of more ribs 202, or less, and in conjunction with a variety of flexible canopy 106 shapes.

FIG. 3 is a top view of the personal fogging umbrella 100 of FIG. 1. As shown, the flexible canopy 106 is supported by the spreader arms 212. According to various embodiments, the flexible canopy 106 is interchangeable, and is releasably coupled to the spreader arms 212 through a series of releasable attachments 300. The releasably attachments 300 may include, but are not limited to, hook-and-loop fasteners, snaps, clips, magnets, hooks, and the like. Those skilled in the art will recognize that any other method of releasably attaching a flexible material to a rigid frame may also be applied. In other embodiments, the flexible canopy 106 may be permanently attached to the spreader arms 212.

Figure 4:
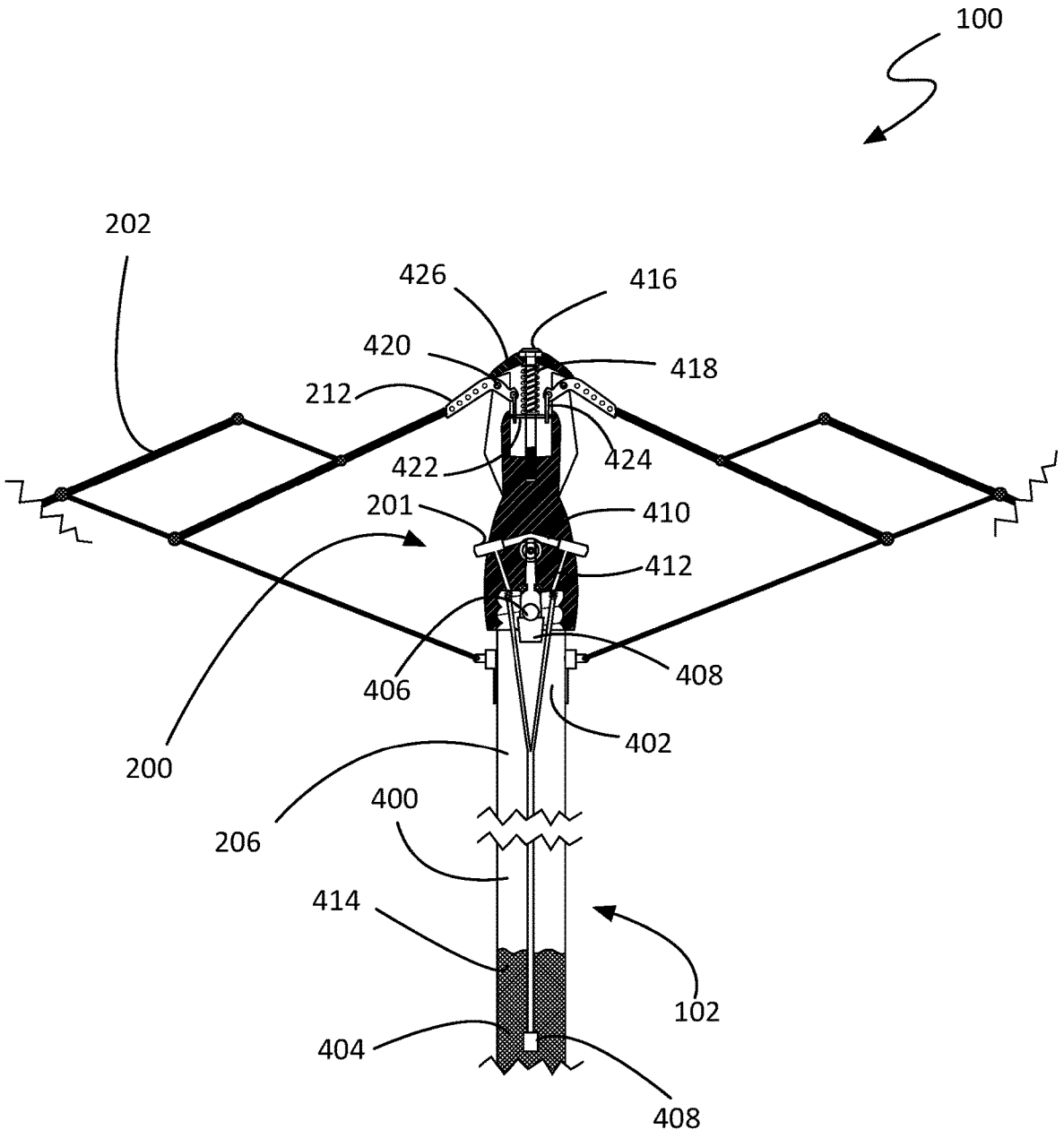
FIG. 4 is a cross-sectional view of the personal fogging umbrella of FIG. 1.

FIG. 4 is a sectional view of the personal fogging umbrella 100 of FIGS. 1-3, taken along line A-A of FIG. 3. As previously mentioned, the handle 102 comprises a hollow cavity 400, the cavity 400 having an upper end 402 and a lower end 404, and the handle 102 having a bottom end 208 coupled to the pressurizer and a top end 206 coupled to the head 200.

According to various embodiments, the head 200 comprises one or more two-stage fogging nozzle 201. In the context of the present description and the claims that follow, a two-stage fogging nozzle 201 refers to a nozzle that is connected to a water supply and receives a supply of pressurized air which siphons the water into the nozzle, where the combination of pressurized air and water is ejected in a cloud of very small water droplets, so small they take on the appearance of fog, rather than mist. In contrast, conventional misting nozzles operate by having a supply of water pushed through a small opening, resulting in a mist made up of larger water droplets. Fogging nozzles typically operate at higher pressures than misting nozzles.

Fogging nozzles 201 are advantageous over misting nozzles, as they use less water (making the mobile supply last longer, or reducing the amount carried) and provide smaller droplets that evaporate faster. When a user is holding the personal fogging umbrella 100 (for example, when resting on their shoulder), the head 200 of the umbrella 100 is in close proximity to their head and neck, prime targets for cooling. Being in close proximity, it is advantageous for the water being ejected to evaporate quickly; if the water droplets are too large, the user may get wet. Although having water sprayed on ones head on a hot day isn't altogether disagreeable, it is not an efficient use of the water supply, and does not provide as much cooling as the nearly immediate evaporation of a fog.

As a specific example, in one embodiment, the personal fogging umbrella 100 may comprise three two-stage fogging nozzles 201, each of which provides a fog made up of water particles having a Sauter mean diameter (SMD) on the order of 16 μm, each operating with the air pressurized to 20 psi. The total flow rate is on the order of 5 ml/minute. Other embodiments may make use of other nozzles operating at higher or lower pressures and providing larger or smaller water particles. In some embodiments, the personal fogging umbrella 100 may be configured to operate at a maximum pressure of 120 psi, while other embodiments may be designed for optimal use between 60 and 80 psi, and still other embodiments designed for optimal use between 60 and 100 psi. Those skilled in the art will recognize that the choice of fogging nozzles, both capacity and number, and the operating pressure of both the pressurizer 104 and the hollow cavity 400, are interdependent, and modifying one may result in changes in the others.

The non-limiting example shown in FIGS. 1-4 comprises 3 two-stage fogging nozzles 201. Other embodiments may comprise 1, 2, 4, 5, or more nozzles 201. As shown, the fogging nozzles 201 are housed within the head 200. This is advantageous over other cooling solutions that place misting nozzles within or at the ends of the ribs of the umbrella. Not only does that position the cooling effect of the evaporating cloud further away from the users body, it requires stronger, more complicated ribs which must support water in addition to the canopy. In addition to using two-stage fogging nozzles 201 instead of misting nozzles, the personal fogging umbrella 100 also positions the nozzles 201 on the head 200 rather than the ribs 202, according to various embodiments.

As shown, each nozzle 201 is communicatively coupled to an air conduit 410 and a water conduit 412. In some embodiments, the air and/or water conduits may be a single piece throughout (e.g. a plastic tube running from the nozzle, through the head 200, and into the hollow cavity 400), while in other embodiments, the air and/or water conduits may be composed of different sections (e.g. a hollow channel through the head 200 coupled to a tube that goes into the hollow cavity 400). In the context of the present description and the claims that follow, the air conduit 410 is a conduit made of one or more pieces that places a fogging nozzle 201 in fluid communication with the upper end 402 of the hollow cavity 400, and the water conduit 412 is a conduit made of one or more pieces that places a fogging nozzle 201 in fluid communication with the lower end 404 of the hollow cavity 400.

The hollow cavity 400 is watertight, meaning its construction and materials are able to contain water, even when the hollow cavity 400 is pressurized. In use, the hollow cavity 400 contains at least some pressurized air, which is found at the upper end 402 of the hollow cavity 400 when the umbrella 100 is being held upright. According to various embodiments, the handle 102 may be filled ¾ full with water to provide sufficient pressure. In other embodiments, the handle 102 may be filled more. As a specific example, in one embodiment, the handle 102 may be sized such that, when filled ¾ full, the handle 102 is holding 32 oz. of water, resulting in a personal fogging umbrella 100 that weighs approximately four and a half pounds.

As previously stated, the air conduits 410 place the fogging nozzles 201 in fluid communication with the upper end 402, and thus able to receive the pressurized air. A check valve 406 may be placed between the hollow cavity 400 and the air conduits 410, meaning the air conduits 410 may terminate at the check valve 406 that is in the upper end 402 of the hollow cavity 400. The check valve 406 is used to prevent accidental water loss due to the umbrella 100 being tipped over or inverted. If the control valve 214 were to be left open and the umbrella 100 tipped over, water would be pushed through the larger air conduits and into the nozzles, resulting in a loss of water at a higher rate than when in proper use. According to various embodiments, the check valve 406 is oriented such that it closes when the umbrella 100 is inverted. Those skilled in the art will recognize that other types of valves may be used in the place of the check valve 406 to prevent this loss.

As shown, the water conduit 412 terminates in the lower end 404 of the hollow cavity 400, in the water 414. According to various embodiments, the water conduits 412 and/or the air conduits 410 may comprise filters 408, to prevent the introduction of particulates to the fogging nozzles 201, which typically have very small apertures.

It may be more accurate to describe FIG. 4 as a side view of the umbrella 100 of FIGS. 1-3 with the handle 102 and head 200 sliced along line A-A of FIG. 3, showing the internal components in a simplified manner. This is noted out only to clarify that FIG. 4 is not meant to limit the placement of the fogging nozzles 201 to the A-A plane, nor to indicate that the inside of the head 200 must be hollow. In some embodiments, the nozzles 201 may be positioned evenly spaced around the head 200, while in others they may be unevenly spaced. Furthermore, in some embodiments, the head 200 may be solid, while in others it may be a hollow shell.

As shown in FIG. 4, the head 200 comprises a mechanism for supporting the ribs 202 in an open or closed configuration. As previously discussed, according to various embodiments, the head 200 may comprise a plurality of spreader arms 212, each coupled to a different rib 202. The spreader arms 212 may pivot on a common spreader locking ring 420 that is coupled to the head 200. The end of each spreader arm 212 may also be pivotally coupled to a spreader arm shaft 424, which is in turn coupled to a spreader arm couple 422 that is also coupled to an end of a spring 418 coiled around a bolt 416 passing through the central axis of a cap 426 of the head 200 and providing a downward bias.

The downward bias of the spring 418 on the spreader arm coupling 422 pulls the end of each spread arm 212 downward, biasing the ribs into the open position. In other words, without intervention, the umbrella 100 may naturally maintain an open state, with ribs extended and the canopy open and providing shade.

According to various embodiments, the umbrella 100 may be locked into a closed position by fixing the collar 210 to the handle 102 requiring the ribs 202 to fold inward against the bias of the spring 418. As an option, the bias of the umbrella 100 may be adjusted by turning the bolt 416, according to various embodiments.

It should be recognized by those skilled in the art that while FIG. 4 shows a specific example of a canopy extending mechanism, other umbrella mechanisms, collars, ribs, arms, etc., could be employed with the contemplated head 200, handle 102, and pressurizer 104 of the personal fogging umbrella 100.

Figure 5:
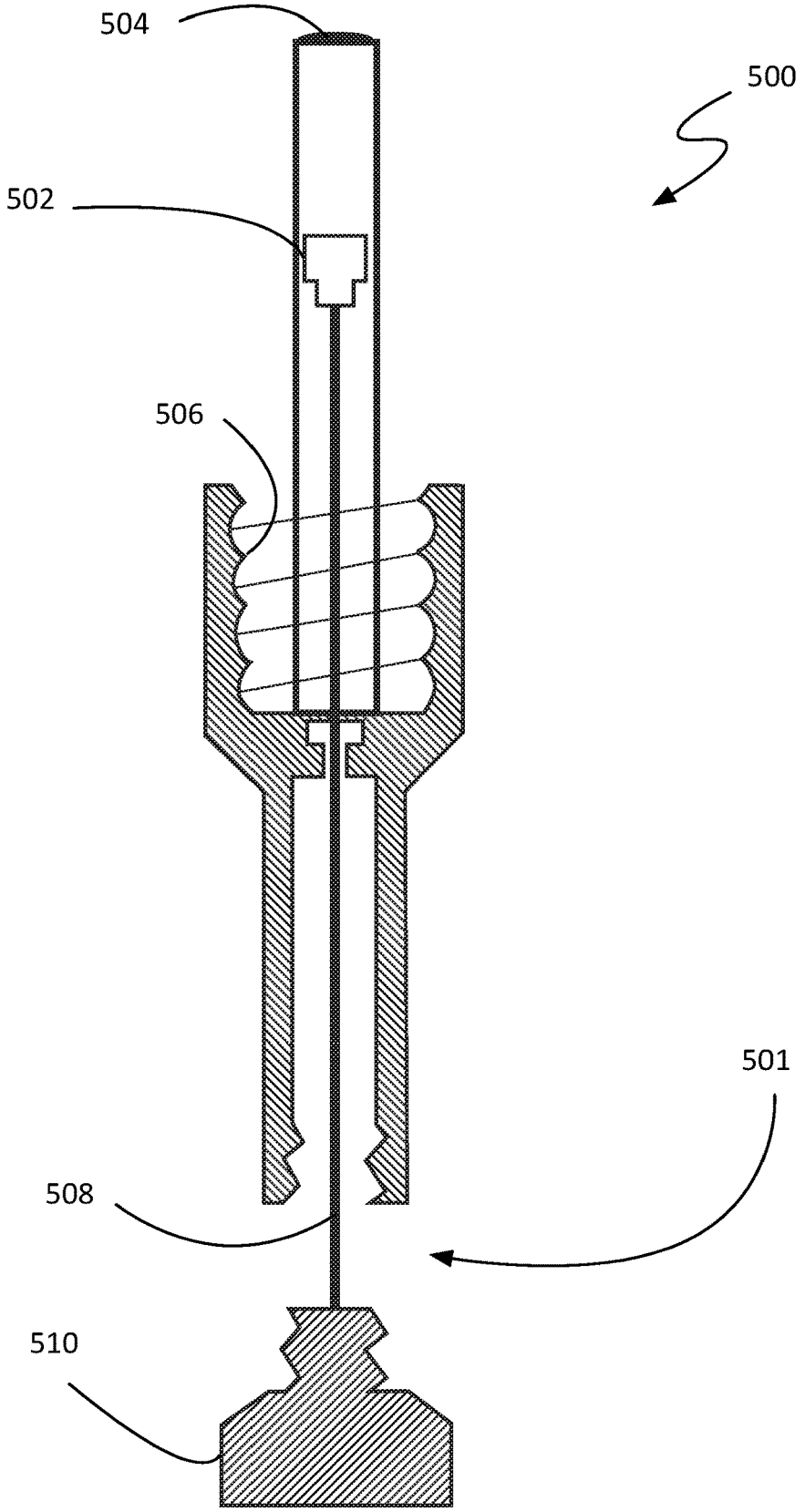
FIG. 5 is a cross-sectional view of a hand-powered pressurizer.

FIG. 5 is a sectional view of a hand-powered pressurizer 500 taken along line A-A of FIG. 3, were the pressurizer 104 of the personal fogging umbrella 100 shown in FIG. 3 a hand-powered pressurizer 500. As shown, the hand-powered pressurizer 500 comprises a hand-operated pump 501 coupled to a one-way valve 504, as discussed above.

The use of a hand-powered pressurizer 500 provides a number of advantages over pressurizers that are powered by electricity (e.g. the electric-powered pressurizer 600 of FIG. 6) or a supply of compressed gas. A hand-powered pressurizer 500 can be operated without requiring electrical charging, new batteries, or refilling of gas; an umbrella 100 using a hand-powered pressurizer 500 would only need a supply of water for continued use throughout a workday, and water should be readily available in the environments where the umbrella 100 is likely to be used, for obvious reasons. Additionally, the absence of gas tanks or batteries may make a hand-powered pressurizer 500 lighter than other types of pressurizers.

According to various embodiments, the hand-operated pump 501 of the hand-powered pressurizer 500 comprises a piston 502 coupled to a grip 510. The piston 502 may be actuated by grabbing the grip 510 and pumping the grip 510 up and down. In some embodiments, the shaft 508 of the piston 502, and thus the linear movement of the grip, may be substantially parallel to the handle proximate the bottom end 208 of the hollow cavity 400. Such an arrangement allows the end of the pump 501, including the one-way valve 504, to extend up into the hollow cavity 400, such that a longer piston 502 may be used without requiring an increase in the size (and weight) of the body of the pressurizer 500. In the context of the present description and the claims that follow, substantially parallel means parallel to within 20°. A longer piston 502 allows the target pressure to be reached with fewer strokes of the piston 502.

In some embodiments, the grip 510 of the pump 501 may be configured such that it can be secured when not in use, protecting the internal mechanisms of the pump 501. As shown, in one embodiment, the grip 510 may fit into the bottom of the pressurizer 500, and may be secured by threading it into a threaded cavity at the end of the pressurizer 500.

It should be recognized that the hand-powered pressurizer 500 may be adapted for use with other forms of hand-operated pumps. For example, in one embodiment, the hand-operated pump 501 may be a double stroke pump, which introduces air into the hollow cavity on both the up stroke and the down stroke of a piston. In other embodiments, the hand-operated pump 501 may be operated with motions that are not linear, including but not limited to twisting along the central axis of the pressurizer, rotating about an axis that is at an angle with the central axis of the pressurizer, compressing a billows-like cavity, and any other hand-operated pump known in the art.

As previously mentioned, the pressurizer 104 is releasably coupled to the handle 102. According to various embodiments, the pressurizer 104 is removed from the handle 102 so the hollow cavity 400 may be refilled with water. As shown, the pressurizer 104 may releasably couple to the handle 102 in a threaded fashion, with the pressurizer having a threaded cavity 506 at the top. In other embodiments, the pressurizer 104 may thread into the inside of the handle 102. In still other embodiments, the nature of the coupling may be something other than threaded, including but not limited to magnetic, linear, friction-based, cinched, and the like. As an option, the interface between the handle 102 and the pressurizer 104 may also include an elastomer gasket, like a rubber O-ring, to make the junction watertight, even under pressure.

Figure 6:
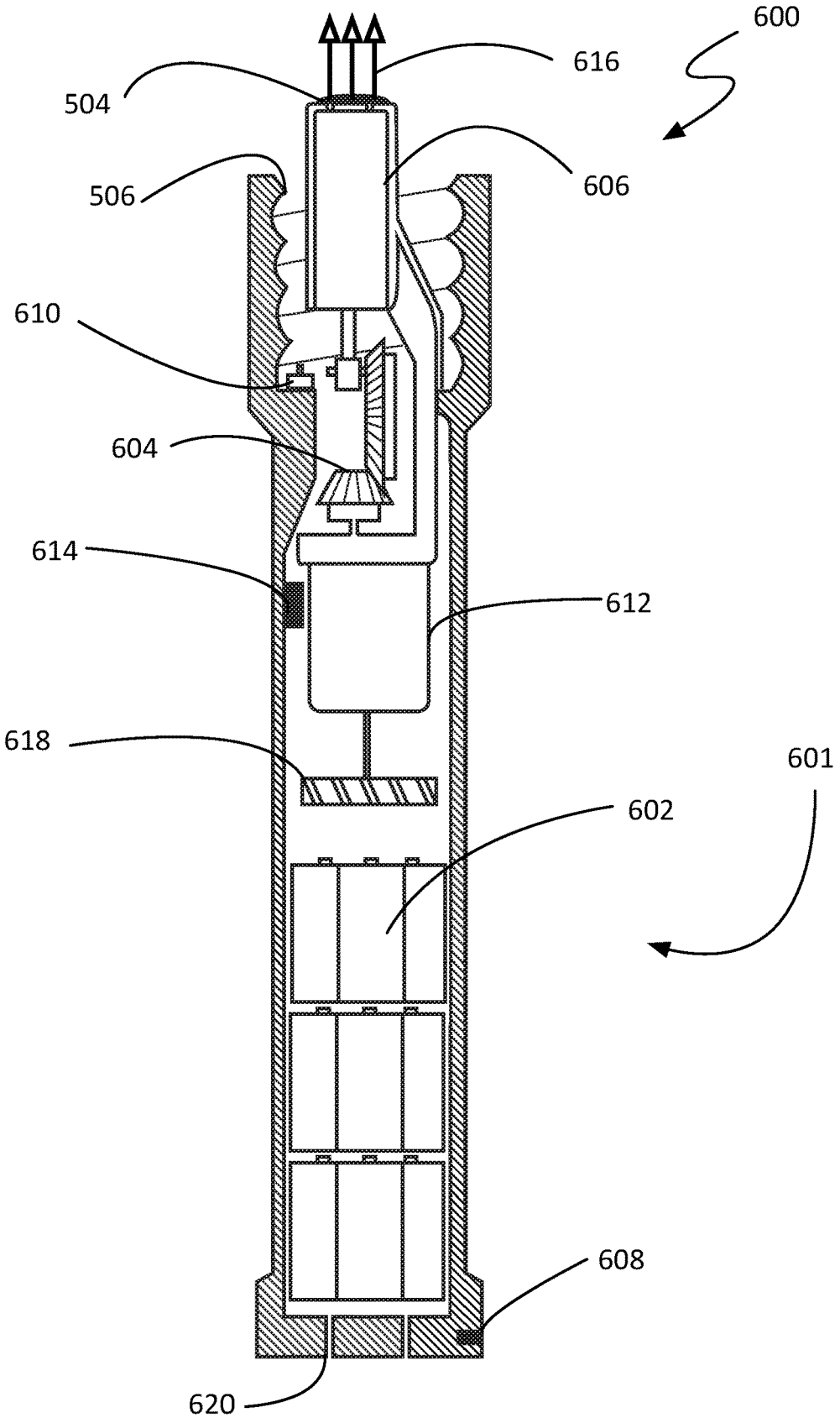
FIG. 6 is a cross-sectional view of an electric pressurizer.

FIG. 6 is a sectional view of an electric-powered pressurizer 600 taken along line A-A of FIG. 3, were the pressurizer 104 of the personal fogging umbrella 100 shown in FIG. 3 an electric-powered pressurizer 600. As shown, the electric-powered pressurizer 600 comprises an electromechanical pump 601 coupled to a one-way valve 504, as discussed above.

The use of an electric-powered pressurizer 600 provides a number of advantages over the hand-powered pressurizer 500 of FIG. 5. First, an electric-powered pressurizer 600 does not require a user to expend energy in pressurizing the hollow cavity 400. Environments in which a personal fogging umbrella 100 is likely to be used are not environments where one wishes to be operating a pump by hand. Additionally, an electric-powered pressurizer 600 may be operated programmatically, such that a sufficient level of pressure is maintained at all times so that a cooing fog is readily available to the user.

According to various embodiments, the electromechanical pump 601 of the electric-powered pressurizer 600 comprises an electric motor 612 that drives a piston 606 coupled to a one-way valve 504. In some embodiments, a rotary motion provided by the motor 612 is converted to a linear motion to drive the piston 606 by a series of gears 604. Those skilled in the art will recognize that the electric-powered pressurizer 600 may be adapted for use with other types of electromechanical pumps 601, as is known in the art.

The electomechanical pump 601 is communicatively coupled to one or more batteries 602 which power the pump 601. In some embodiments, the batteries 602 may be conventional, disposable batteries, which may be advantageous as high temperatures is known to reduce the lifespan of batteries, and disposable batteries would be less expensive to replace than rechargeable batteries. However, in other embodiments, the batteries 602 may be rechargeable, which in addition to convenience and possibly reduced total cost over the life of the umbrella, also provides the advantage of being able to be sealed within the pressurizer 600, making the device more rugged and easier to protect from water damage. As an option, the electric-powered pressurizer 600 may further comprise a charging port 608 communicatively coupled to the at least one battery 602. As a specific example, in one embodiment, the charging port 608 may be a micro USB port, and may be compatible with the nearly omnipresent phone charger may people keep readily available.

Another advantage of electric-powered pressurizers 600 is that they may be configured to rely less on user control. For example, in some embodiments, the pressurizer 600 may include a processor 614 communicatively coupled to the electromechanical pump 601 and a sensor, such as a pressure sensor 610. The processor 614 may be programmatically configured to automatically activate the pump 601 such that the air pressure 616 inside the hollow cavity 400 is maintained within a particular pressure range ideal for operation. As a specific example, in one embodiment, the pressurizer 600 may be configured to maintain an air pressure between 60 and 80 psi inside of the hollow cavity 400.

According to various embodiments, the electric-powered pressurizer 600 may include sensors and switches other than, or in addition to, a pressure sensor 610. For example, in one embodiment, the pressurizer 600 may include a temperature sensor located proximate the motor 612 and/or the batteries 602, both of which can overheat if used in a hot environment. The processor 614 may be configured to automatically turn off the pump 601 if a critical temperature is exceed, to protect the device from permanent damage. As an option, the user may alerted to the temperature condition with a sound, light, or other method known in the art.

In another embodiment, the pressurizer 600 may include a switch or sensor configured to detect when the pressurizer 600 has been coupled to the handle 102 and is in contact with water. In other words, the pressurizer 600 may be configured to automatically turn on and being maintaining a predefined pressure range within the hollow cavity 400 upon determining that the hollow cavity 400 contains water, and to automatically turn off when the water has been exhausted or the pressurizer 600 has been removed from the handle 102.

As shown in FIG. 6, some embodiments of the electric-powered pressurizer 600 may include features to assist in maintaining a safe operating temperature for the pump 601 and/or batteries 602. For example, some embodiments may include a fan 618 and one or more air vents 620, to air-cool the internal components. As an option, the fan 618 may be automatically operated by the processor 614 in response to temperature readings from a sensor.

In some embodiments, the operation of the electric-powered pressurizer 600 may be automatic, as described above. In other embodiments, the operation may be manually triggered. For example, in one embodiment, the user may press a button or toggle a switch to begin pressurizing the hollow cavity 400. The shut off may be automatic (e.g. triggered by a pressure sensor, etc.), manual (e.g. wait for user interaction), or mechanically automated (e.g. a relief valve may vent when a particular pressure is exceeded, alerting the user to turn off the pump 601).

The various components of the personal fogging umbrellas 100 contemplated herein may be constructed from various materials known in the art. In some embodiments, the handle 102 may be composed of carbon fiber, providing a strong and watertight hollow cavity 400 without excessive weight. In other embodiments, the handle 102 may be constructed of plastic, such as PVC, or other materials known in the art. The flexible canopy 106 may be composed of a woven material, a flexible plastic or elastomer, a foil, or other materials known in the art of umbrella making. The body of the pressurizer 104 may be constructed of a strong material such as thermoplastic, metal, or the like.

Where the above examples, embodiments and implementations reference examples, it should be understood by those of ordinary skill in the art that other personal fogging umbrellas and examples could be intermixed or substituted with those provided. In places where the description above refers to particular embodiments of umbrellas, handles, and pressurizers, it should be readily apparent that a number of modifications may be made without departing from the spirit thereof and that these embodiments and implementations may be applied to other personal cooling systems and umbrellas as well. Accordingly, the disclosed subject matter is intended to embrace all such alterations, modifications and variations that fall within the spirit and scope of the disclosure and the knowledge of one of ordinary skill in the art.

What is claimed is:

1. A personal fogging umbrella, comprising:

a handle comprising a top end, a bottom end, and a hollow cavity spanning from the top end of the handle to the bottom end of the handle;

a head coupled to the top end of the handle and comprising a plurality of spreader arms, a control valve, and a plurality of two-stage fogging nozzles in fluid communication with the control valve, each two-stage fogging nozzle in fluid communication with an upper end of the hollow cavity via an air conduit and with a lower end of the hollow cavity via a water conduit, the plurality of spreader arms pivotally coupled to the head;

a collar moveably coupled to the handle;

a plurality of ribs, each rib coupled to the collar and a different one of the plurality of spreader arms;

a canopy coupled to the plurality of ribs; and a pressurizer releasably coupled to the handle and in fluid communication with the plurality of two-stage fogging nozzles through the hollow cavity.

2. The personal fogging umbrella of claim 1, wherein the pressurizer is a hand-powered pressurizer comprising a hand-operated pump and a grip for operating the hand-operated pump, the grip threadedly coupled to the hand-powered pressurizer when not in use.

3. The personal fogging umbrella of claim 1, wherein the pressurizer is coupled to the bottom end of the handle.

4. The personal fogging umbrella of claim 1, wherein the handle further comprises a shoulder rest between the top end and the bottom end, the handle above the shoulder rest being substantially linear, and the handle below the shoulder rest being at least partially curved.

5. A personal fogging umbrella, comprising:

a handle comprising a top end, a bottom end, and a hollow cavity spanning from the top end of the handle to the bottom end of the handle;

a head coupled to the top end of the handle and comprising a plurality of spreader arms, a control valve, and a plurality of two-stage fogging nozzles in fluid communication with the control valve, each two-stage fogging nozzle in fluid communication with an upper end of the hollow cavity via an air conduit and with a lower end of the hollow cavity via a water conduit, the plurality of spreader arms moveably coupled to the head;

a collar moveably coupled to the handle;

a plurality of ribs, each rib coupled to the collar and a different one of the plurality of spreader arms;

a canopy coupled to the plurality of ribs; and a pressurizer coupled to the handle and in fluid communication with the plurality of two-stage fogging nozzles through the hollow cavity.

6. The personal fogging umbrella of claim 5, wherein the pressurizer is a hand-powered pressurizer comprising a hand-operated pump.

7. The personal fogging umbrella of claim 6, wherein the hand-powered pressurizer further comprises a grip for operating the hand-operated pump, the grip threadedly coupled to the hand-powered pressurizer when not in use.

8. The personal fogging umbrella of claim 5, wherein the control valve is in fluid communication with the plurality of two-stage foggind nozzles through at least one of an air conduit and a water conduit.

9. The personal fogging umbrella of claim 5, wherein the pressurizer is coupled to the bottom end of the handle.

10. A personal fogging umbrella, comprising:

a handle comprising a top end, a bottom end, and a hollow cavity;

a head coupled to the top end of the handle and comprising a plurality of spreader arms and a plurality of two-stage fogging nozzles, each two-stage fogging nozzle in fluid communication with an upper end of the hollow cavity via an air conduit and with a lower end of the hollow cavity via a water conduit, the plurality of spreader arms moveably coupled to the head;

a collar moveably coupled to the handle;

a plurality of ribs, each rib coupled to the collar and a different one of the plurality of spreader arms;

a canopy coupled to the plurality of ribs; and a pressurizer coupled to the handle and in fluid communication with the plurality of two-stage fogging nozzles through the hollow cavity.

11. The personal fogging umbrella of claim 10, wherein the head further comprises a control valve in fluid communication with the plurality of two-stage fogging nozzles.

12. The personal fogging umbrella of claim 11, wherein the control valve is in fluid communication with the plurality of two-stage fogging nozzles through at least one of an air conduit and a water conduit.

13. The personal fogging umbrella of claim 10, wherein the pressurizer is a hand-powered pressurizer comprising a hand-operated pump.

14. The personal fogging umbrella of claim 13, wherein the hand-powered pressurizer further comprises a grip for operating the hand-operated pump, the grip threadedly coupled to the hand-powered pressurizer when not in use.

15. The personal fogging umbrella of claim 10, wherein the hollow cavity spans from the top end of the handle to the bottom end of the handle.

16. The personal fogging umbrella of claim 10, wherein the pressurizer is releasably coupled to the handle.

17. The personal fogging umbrella of claim 10, wherein the pressurizer is coupled to the bottom end of the handle.

18. The personal fogging umbrella of claim 10, wherein the handle further comprises a shoulder rest between the top end and the bottom end.

19. The personal fogging umbrella of claim 18, wherein the handle above the shoulder rest is substantially linear, and the handle below the shoulder rest is at least partially curved.

20. The personal fogging umbrella of claim 10, wherein the hollow cavity is sized to hold approximately 32 oz. of water when ¾ full.

* * * * *